US011585548B2

(12) United States Patent
Yang et al.

(10) Patent No.: US 11,585,548 B2
(45) Date of Patent: Feb. 21, 2023

(54) AIR PURIFIER WITH AIR OUTLET GUIDER

(71) Applicant: ETEKCITY CORPORATION, Anaheim, CA (US)

(72) Inventors: Lin Yang, Shenzhen (CN); Hai Yang, Shenzhen (CN)

( * ) Notice: Subject to any disclaimer, the term of this patent is extended or adjusted under 35 U.S.C. 154(b) by 712 days.

(21) Appl. No.: 16/586,477

(22) Filed: Sep. 27, 2019

(65) Prior Publication Data

US 2020/0224892 A1 Jul. 16, 2020

(30) Foreign Application Priority Data

Jan. 16, 2019 (CN) ..... 201920083396.9

(51) Int. Cl.

| | |
|---|---|
| ***F24F 8/80*** | (2021.01) |
| ***F24F 1/035*** | (2019.01) |
| ***F24F 1/029*** | (2019.01) |
| ***F24F 1/0287*** | (2019.01) |
| ***F24F 13/24*** | (2006.01) |
| ***F24F 8/10*** | (2021.01) |

(52) U.S. Cl.

CPC ..... *F24F 8/80* (2021.01); *F24F 1/029* (2019.02); *F24F 1/0287* (2019.02); *F24F 1/035* (2019.02); *F24F 8/10* (2021.01); *F24F 13/24* (2013.01)

(58) Field of Classification Search

CPC ..... F24F 1/035; F24F 1/0287; F24F 1/029; F24F 8/10; F24F 13/24; F24F 2013/205

USPC ..... 422/120

See application file for complete search history.

(56) References Cited

U.S. PATENT DOCUMENTS

| | | | | |
|---|---|---|---|---|
| 2004/0033135 | A1* | 2/2004 | Chang | F04D 29/544 415/220 |
| 2008/0166232 | A1* | 7/2008 | Pearce | F04D 29/703 415/220 |
| 2017/0246570 | A1* | 8/2017 | Park | B01D 46/0041 |
| 2017/0246576 | A1* | 8/2017 | Jung | B01D 46/0005 |

FOREIGN PATENT DOCUMENTS

CN 206377068 U * 8/2017

* cited by examiner

*Primary Examiner* — Steve S Tanenbaum
(74) *Attorney, Agent, or Firm* — Tsz Lung Yeung

(57) ABSTRACT

An air purifier includes a main housing, an air filter, a driving motor, a centrifugal fan, and an air outlet guider. The air outlet guider includes a central hub connected to the driving motor, a plurality of outlet guiding blades outwardly extended from the central hub, and a peripheral rim connected to the central hub at a distance from the central hub to form an air guiding cavity between the central hub and the peripheral rim. The outlet guiding blades extend in the air guiding cavity. When the driving motor is activated to draw air from the air inlet, the air is forced to sequentially pass through the filter assembly and the guiding cavity. The air in the air guiding cavity is diverted and guided by the outlet guiding blades to form a more streamlined flow which is to be discharged through the air outlet.

15 Claims, 7 Drawing Sheets

AIR PURIFIER WITH AIR OUTLET GUIDER

BACKGROUND OF THE PRESENT INVENTION

Field of Invention

The present invention relates to an air purifier, and more particularly to an air purifier comprising an air outlet guider which is capable of minimizing formation of vortex for outgoing air and minimizing noise produced by the present invention.

Description of Related Arts

With the improvement of living standards around the world and particularly developed countries, the demand for indoor air quality is becoming higher and higher. As a result, various kinds of air purifiers have been made available for domestic use. These conventional air purifiers may deliver filtered air in an indoor space so as to allow people staying in the indoor space to have access to cleaner air.

A conventional air purifier may include a main housing having an air inlet and an air outlet, a centrifugal fan mounted in the main housing for drawing air to move from the air inlet and the air outlet, and a plurality of air filters mounted in the main housing at a position between the air inlet and the air outlet. Air drawn from the air inlet is guided to pass through the air filters and then discharged out of the air purifier through the air outlet.

A major disadvantage of conventional air purifiers such as the one described above is that the air coming out from the main housing will form vortex flow and produce a considerable amount of noise. Moreover, air flow in the form of vortex may not be ideal for an indoor space. As a result, there is a need to develop an air purifier which is capable of minimizing noise and producing well-guided outgoing air flow.

SUMMARY OF THE PRESENT INVENTION

Certain variations of the present invention provide an air purifier comprising an air outlet guider which is capable of minimizing formation of vortex for outgoing air and minimizing noise produced by the present invention.

Certain variations of the present invention provide an air purifier comprising an air outlet guider which comprises a plurality of outlet guiding blades for guiding flow of air from a filter, wherein the outlet guiding blades may be shaped and designed to have a wide variety of contours for achieving different air guiding performance for the air purifier.

In one aspect of the present invention, it provides an air purifier, comprising:

a main housing having an air inlet and an air outlet;

at least one air filter assembly supported in the main housing;

a driving motor supported in the main housing;

a centrifugal fan connected to the driving motor; and an air outlet guider which is supported in the main housing at a position adjacent to the air outlet and comprises:

a central hub connected to the driving motor;

a plurality of outlet guiding blades outwardly extended from the central hub; and a peripheral rim connected to the central hub at a distance from the central hub to form an air guiding cavity between the central hub and the peripheral rim, the outlet guiding blades extending in the air guiding cavity, wherein when the driving motor is activated to draw air from the air inlet, the air is forced to sequentially pass through the air filter and the air guiding cavity, the air in the guiding cavity being diverted and guided by the outlet guiding blades to form a more streamlined flow which is to be discharged through the air outlet.

This summary presented above is provided merely to introduce certain concepts and not to identify any key or essential features of the claimed subject matter.

DETAILED DESCRIPTION OF THE PREFERRED EMBODIMENT

Figure 1:
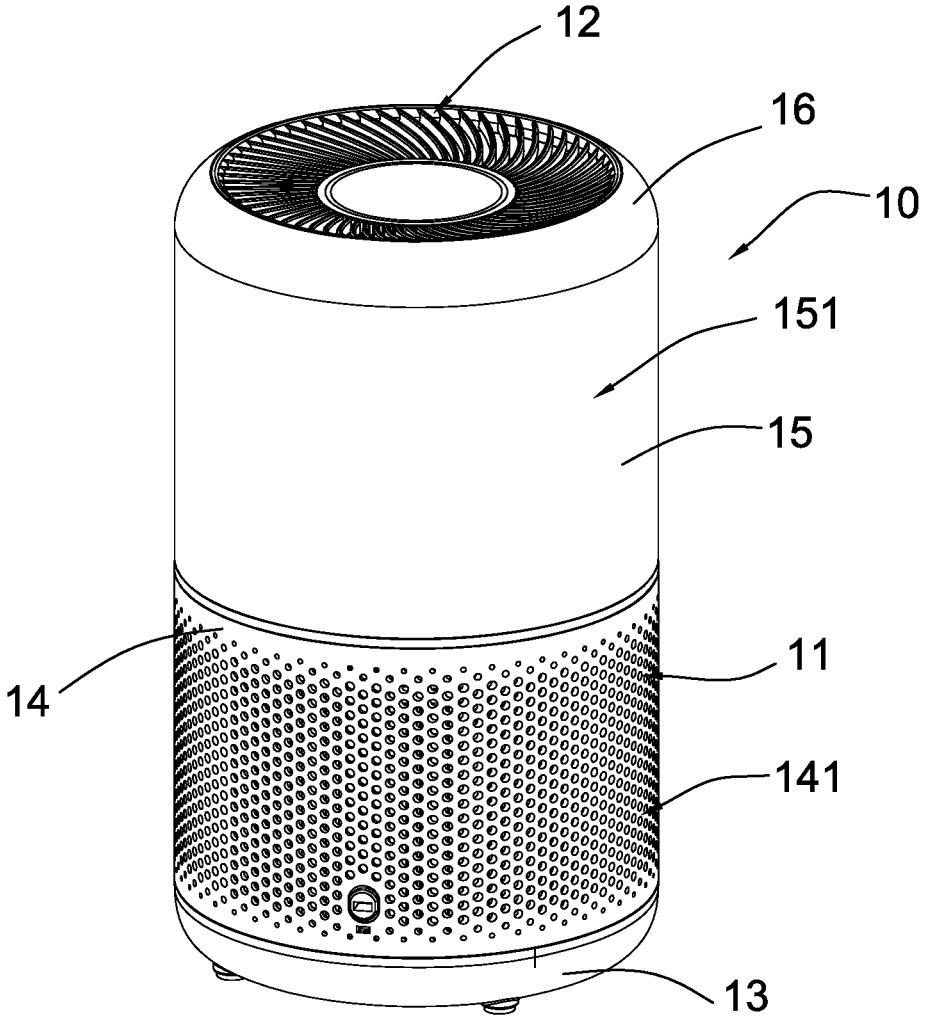
FIG. 1 is a perspective view of an air purifier according to a preferred embodiment of the present invention.

The following detailed description of the preferred embodiment is the preferred mode of carrying out the invention. The description is not to be taken in any limiting sense. It is presented for the purpose of illustrating the general principles of the present invention.

Referring to FIG. 1 to FIG. 10 of the drawings, an air purifier according to a preferred embodiment of the present invention is illustrated. Broadly, the air purifier may comprise a main housing 10 having an air inlet 11 and an air outlet 12, at least one air filter 21 supported in the main housing 10, a driving motor 30 supported in the main housing 10, a centrifugal fan 40 connected to the driving motor 30, and an air outlet guider 50. The air purifier may be utilized to filter air in a designated indoor space, such as inside a room. Filtered air may be released into the air so as to allow a user of the present invention to have access to filtered, cleaner air.

The air outlet guider 50 may be supported in the main housing 10 at a position adjacent to the air outlet 12, and may comprise a central hub 51 connected to the driving motor 30, a plurality of outlet guiding blades 52, and a peripheral rim 53.

The outlet guiding blades 52 may be outwardly extended from the central hub 51. On the other hand, the peripheral rim 53 may be connected to the central hub 51 at a distance from the central hub 51 to form an air guiding cavity 54 between the central hub 51 and the peripheral rim 53. The outlet guiding blades 52 may extend in the air guiding cavity 54, wherein when the driving motor 30 is activated to draw air from the air inlet 11, the air is forced to sequentially pass through the air filter 21 and the air guiding cavity 54. The air in the air guiding cavity 54 may be diverted and guided by the outlet guiding blades 52 to form a more streamlined flow which is to be discharged through the air outlet 12.

According to the preferred embodiment of the present invention, the main housing 10 may comprise a base 13, a lower housing member 14 connected to and upwardly extended from the base 13, an upper housing member 15 connected to and upwardly extended from the lower housing member 14, and an air discharge member 16 supported on top of the upper housing member 15. In this preferred embodiment, each of the base 13, the lower housing member 14, the upper housing member 15 and the air discharge member 16 may have a substantially circular cross-sectional shape when viewed from the top so that the main housing 10 may form a substantially cylindrical structure, as shown in FIG. 1 of the drawings.

The main housing 10 may have a receiving cavity 17 extending through the base 13, the lower housing member 14 and the upper housing member 15 for receiving the filter 21, the driving motor 30, the centrifugal fan 40 and other electrical and mechanical components of the air purifier of the present invention.

In this preferred embodiment of the present invention, the main housing 10 may comprise a plurality of air inlets 11 formed on the lower housing member 14. The air inlets 11 may communicate the receiving cavity 17 with an exterior of the main housing 10. Thus, air may be drawn from the designated indoor space to the receiving cavity 17 through the air inlets 11. The air inlets 11 may be distributed along an external wall 141 of the lower housing member 14.

Figure 2:
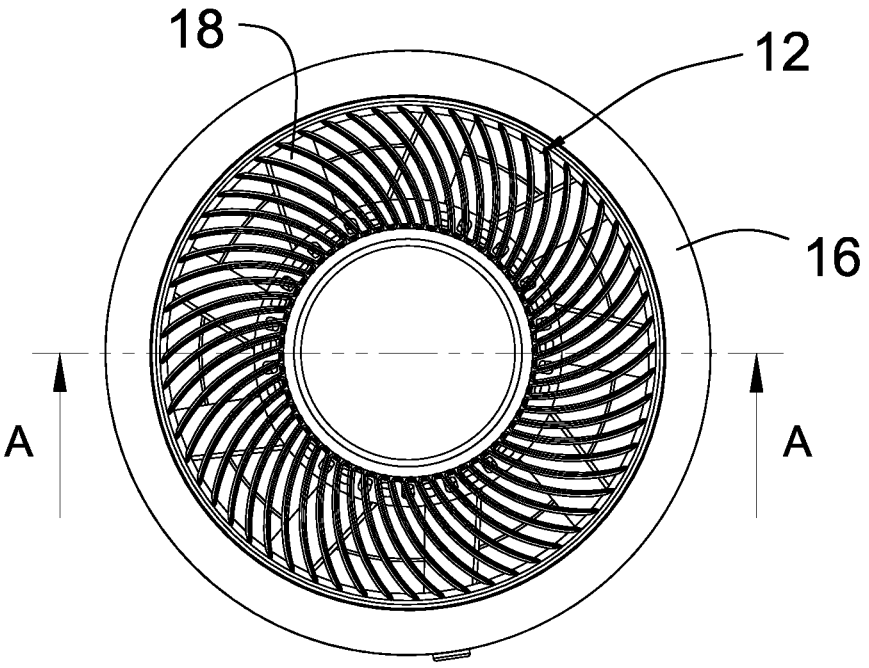
FIG. 2 is a plan view of the air purifier according to the preferred embodiment of the present invention.

On the other hand, the main housing 10 may comprise a plurality of air outlets 12 and a plurality of outlet blades 18 formed on the air discharge member 16, wherein the air outlets 12 may be formed as the space between the outlet blades 18, as shown in FIG. 1 and FIG. 2 of the drawings.

Figure 3:
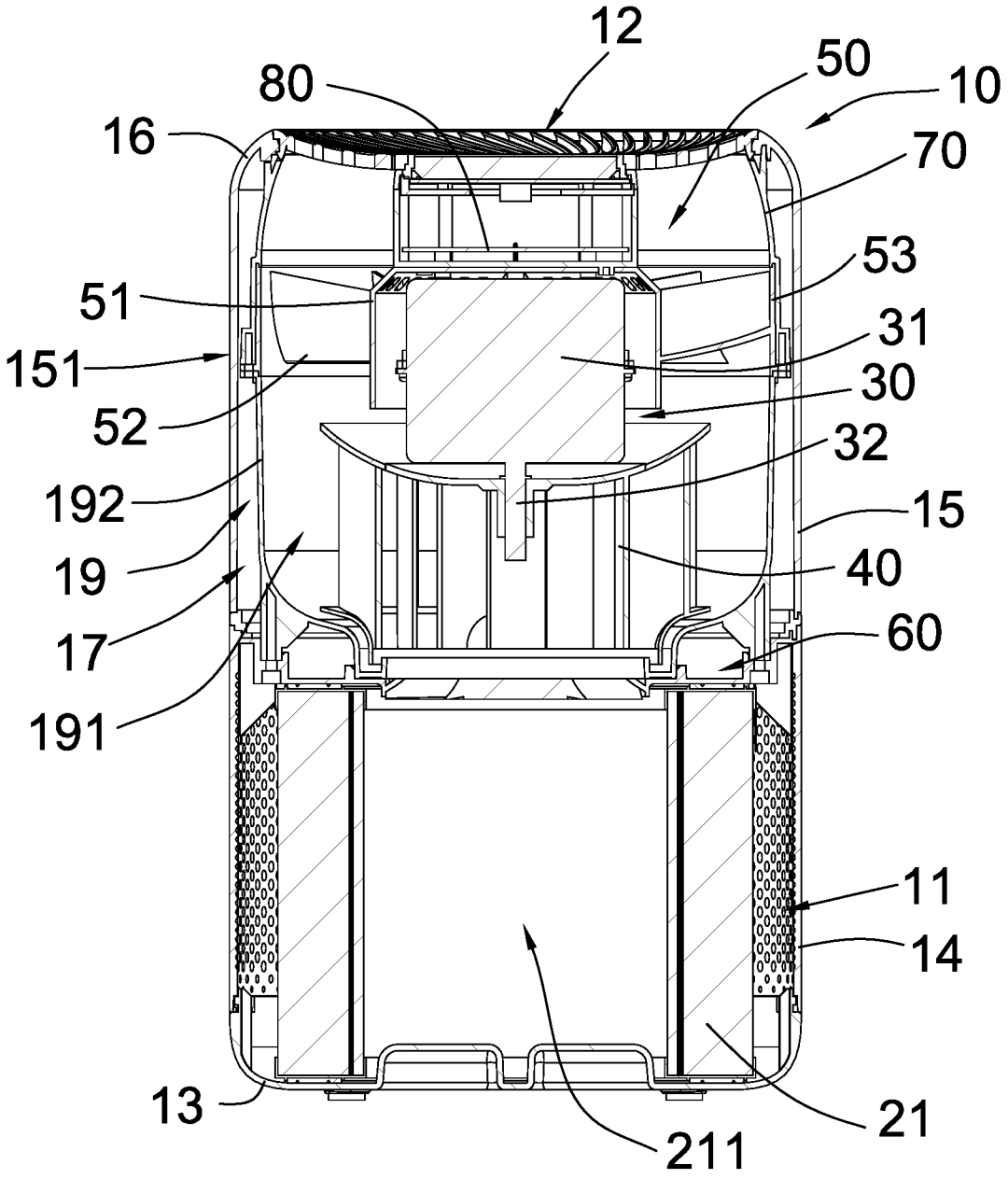
FIG. 3 is a sectional view of the air purifier along plane A-A of FIG. 2.
Figure 4:
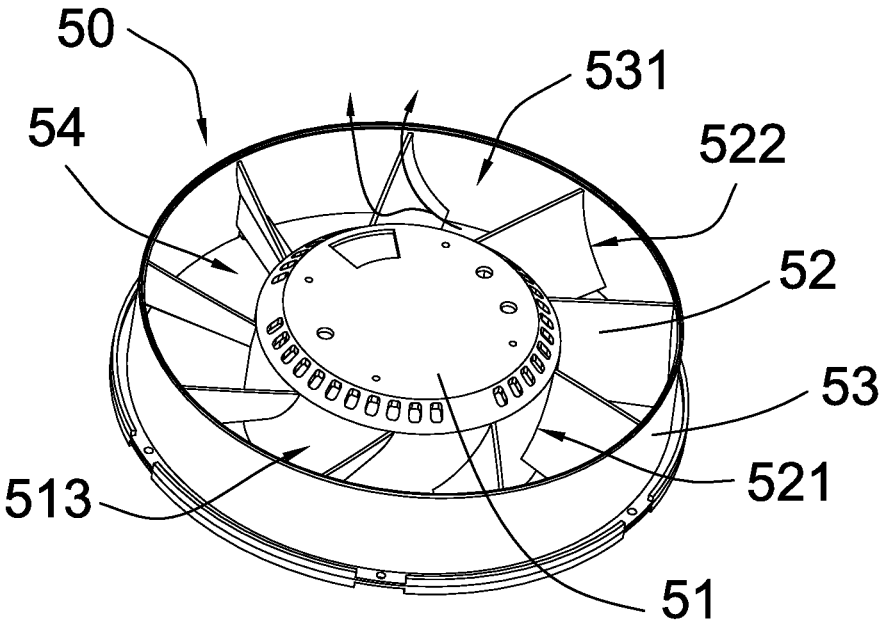
FIG. 4 is a perspective view of an air outlet guider of the air purifier according to the preferred embodiment of the present invention.

The filter 21 may be detachably supported in the lower housing member 14 of the main housing 10 for trapping unwanted substances in the air drawn from the air inlets 11. As shown in FIG. 3 of the drawings, the air filter 21 may be positioned adjacent to the air inlets 11 so that air flowing from the air inlets 11 may be guided to pass through the air filter 21. In this preferred embodiment, the air filter 21 may be configured as having a cylindrical structure so that it may have an annular cross-sectional shape when viewed from the top. Air from the indoor space may be drawn from the air inlets 11 and may be guided to pass through the air filter 21. After that, unwanted substances or particles may be trapped by the air filter 21. Filtered air may be allowed to pass through the air filter 21 and enter the central space 211 surrounded by the circular air filter 21.

The air filter 21 may be configured as High-Efficiency Particulate Air (HEPA) filter which is capable of particulates having a diameter of less than 0.5 μm. The air purifier of the present invention may actually comprise more than one air filter 21 so as to effectively filter particles of various sizes. Moreover, active carbon filter may also be installed for removing contaminants and impurities through chemical adsorption.

Referring to FIG. 3 of the drawings, the centrifugal fan 40 and the driving motor 30 may be mounted in the upper housing member 15 of the main housing 10. These components may be positioned above the air filter 21. The driving motor 30 may comprise a main driving unit 31 and a driving shaft 32 extended from the main driving unit 31. The driving shaft 32 may be connected to the centrifugal fan 40 so that when the driving shaft 32 is driven to rotate, the centrifugal fan 40 may also be driven to rotate for drawing air to flow from the lower housing member 14 to the upper housing member 15.

The main housing 10 may further comprise a supporting frame 19 mounted in the upper housing member 15. The supporting frame 19 has a side boundary 192 defining a central cavity 191 surrounded by the side boundary 192. The centrifugal fan 40 and the driving motor 30 may be mounted in the upper housing member 15 at a position within the central cavity 191. There may exist a distance between the centrifugal fan 40 and the side boundary 192 of the supporting frame 19. Likewise, there may exist a distance between the driving motor 30 and the side boundary 192. Moreover, the air outlet guider 50 may also be mounted at a position in the central cavity 191 of the supporting frame 19. In other words, the supporting frame 19 may extend along a longitudinal direction of the upper housing member 15. As shown in FIG. 3, the side boundary 192 may be mounted at a position near or adjacent to the outer wall 151 of the upper housing member 15.

The centrifugal fan 40 may be arranged to draw air sidewardly from the air inlets 11 and drive air upwardly to the air outlets 12. The air drawn from the air inlets 11 may be forced to pass through the air filter 21, the centrifugal fan 40, the air outlet guider 50, the outer blades 18, and finally the air outlets 12. During this air flowing route, unwanted particulates or particles may be trapped by the air filter 21 and cleaner air may be discharged out of the air purifier through the air outlets 12.

The air outlet guider 50 may be positioned above the centrifugal fan 40 in the upper housing member 15. As shown in FIG. 3 to FIG. 6 of the drawings, the central hub 51 may have an accommodating cavity 511 and an opening 512 for the accommodating cavity 511. The accommodating cavity 511 may be shaped and sized to accommodate the main driving unit 31 of the driving motor 30. The accommodating cavity 511 may at least partially accommodate the main driving unit 31 of the driving motor 30. Since the air outlet guider 50 may be positioned above the centrifugal fan 40, the opening 512 may face downwardly in the upper housing member 15 while the driving motor 30 and the centrifugal fan 40 may downwardly extend from the air outlet guider 50. The central hub 51 may also have a circular cross-sectional shape when viewed from the top.

The peripheral rim 53 may be concentrically provided at a distance (offset) from the central hub 51. The peripheral rim 53 may have an annular or ring-shaped structure so that the air guiding cavity 54 may be formed between an outer side surface 513 of the central hub 51 and an inner side surface 531 of the peripheral rim 53. The outlet guiding blades 52 extend from the central hub 51 to the peripheral rim 53. In this preferred embodiment, each of the outlet guiding blades 52 may have an inner end 521 connected to the outer side surface 513 of the central hub 51, and an outer end 522 connected to the inner side surface 531 of the peripheral rim 53. Filtered air drawn by the centrifugal fan 40 may be forced to pass through the air guiding cavity 54 and the outlet guiding blades 52.

Depending on manufacturing circumstances of the present invention, it is worth mentioning that the outlet guiding blades 52, the central hub 51 and the peripheral rim 53 may form an integral body. Conversely, the central hub 51, the outlet guiding blades 52 and the peripheral rim 53 may be separate components and may be attached to each other in the manner described above through conventional connectors.

Note that the centrifugal fan 40, the driving motor 30 and the air outlet guider 50 may be supported in the central cavity 191 of the supporting frame 19. Air flowing in the central cavity 191 may be guided to pass through the air guiding cavity 54 and the outlet guiding blades 52 as the only exit for the filtered air.

Figure 5:
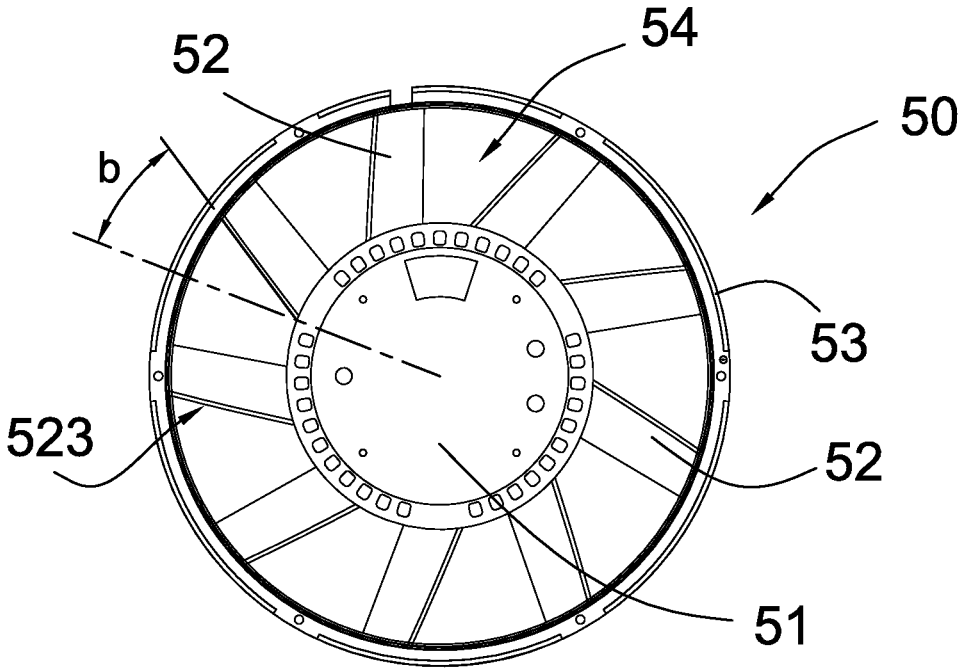
FIG. 5 a plan view of the air outlet guider of the air purifier according to the preferred embodiment of the present invention.
Figure 6:
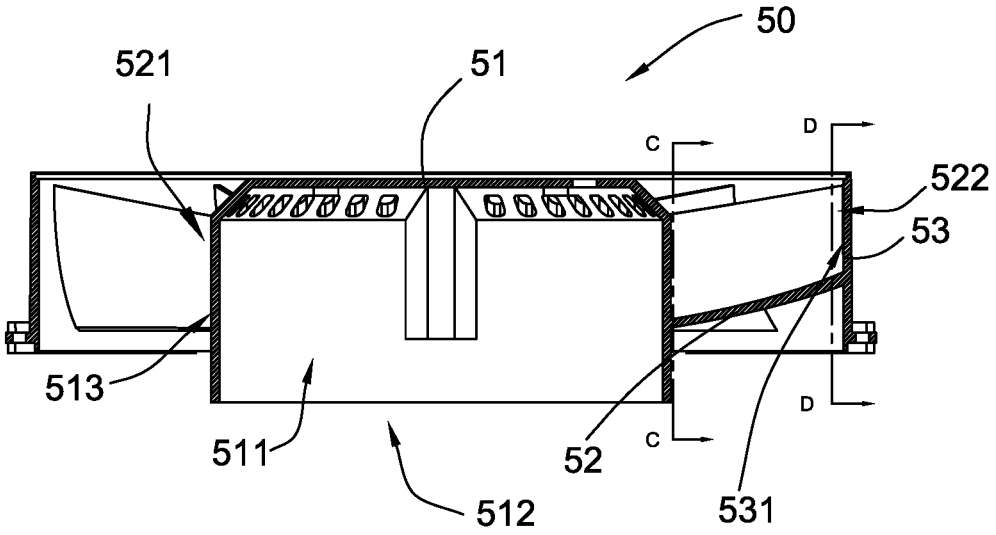
FIG. 6 is a side sectional view of the air outlet guider along plane C-C of FIG. 6.
Figure 7:
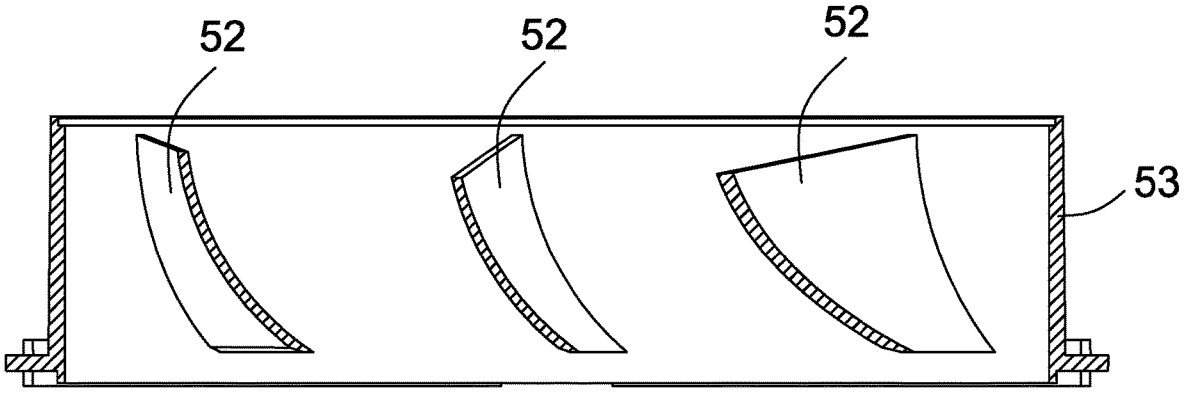
FIG. 7 is a side sectional view of the air outlet guider along plane D-D of FIG. 6.
Figure 8:
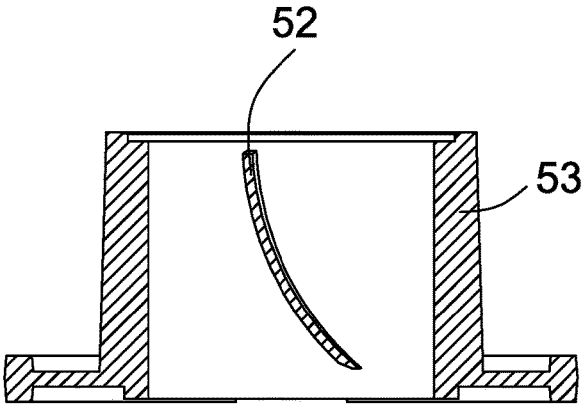
FIG. 8 is another schematic diagram of the air outlet guider of the air purifier according to the preferred embodiment of the present invention.

Referring to FIG. 5 of the drawings, each of the outlet guiding blades 52 may outwardly extend from the central hub 51. The direction of extension for each of the outlet guiding blades 52 may depend on manufacturing and design circumstances. For example, a direction of extension of an upper edge 523 of each of the outlet guiding blades 52 may be offset from a radial direction of the central hub 51 by a predetermined angle of inclination b. This configuration may be illustrated in FIG. 5 of the drawings. Alternatively, each of the outlet guiding blades 52 may extend from the central hub 51 along a radial direction thereof. In this case, the predetermined angle of inclination b mentioned above becomes zero.

Referring to FIG. 4 to FIG. 8 of the drawings, each of the outlet guiding blades 52 has a varying radius of curvature from the peripheral rim 53 to the central hub 51. Specifically, each of the outlet guiding blades 52 has a decreasing radius of curvature from the outer end 522 to the inner end 521 so that air flowing near the inner end 521 of the outlet guiding blades 52 may be directed and guided to become more streamlined and to move in an upward direction toward the air discharge member 16.

The air flowing around the outer end 522 of the outlet guiding blades 52 may form a mix of vortex flow and turbulent flow. This creates a substantial amount of noise and uncontrolled air flow. The contour and radius of curvature of the outlet guiding blades 52 may gradually direct and guide the air flowing around the outer ends 522 of the outlet guiding blades 52 toward the inner ends 521 thereof. The exact radius of curvature of each of the outlet guiding blades 52 may depend on the design and manufacturing circumstances of the present invention.

The air purifier may further comprise an air inlet guider 60 provided in the main housing 10 at a position between the air filter 21 and the centrifugal fan 40. The purpose of the air inlet guider 60 is to divert and guide the flow of air before it enters the centrifugal fan 40. Specifically, the air inlet guider 60 may comprise an air blocker frame 63 mounted in the main housing 10 to segregate the air filter 21 from the centrifugal fan 40, a central guider frame 61 mounted in the air blocker frame 63, and a plurality of inlet guider blades 62 outwardly extended from the central guider frame 61 wherein filtered air from the air filter 21 may be arranged to hit the inlet guider blades 62 and pass through the spaces formed between the inlet guider blades 62.

The air blocker frame 63 may have a circular cross-sectional shape which resembles the cross-sectional shape of the main housing 10. The air blocker frame 63 may have a through central cavity 631 in which the central guider frame 61 and the inlet guider blades 62 may be mounted in the central cavity 631. Thus, the air blocker frame 63 may actually have a ring-shape structure so that air from the air filter 21 may only be allowed to pass through the air blocker frame 63 to reach the centrifugal fan 40 through the central cavity 631.

Figure 9:
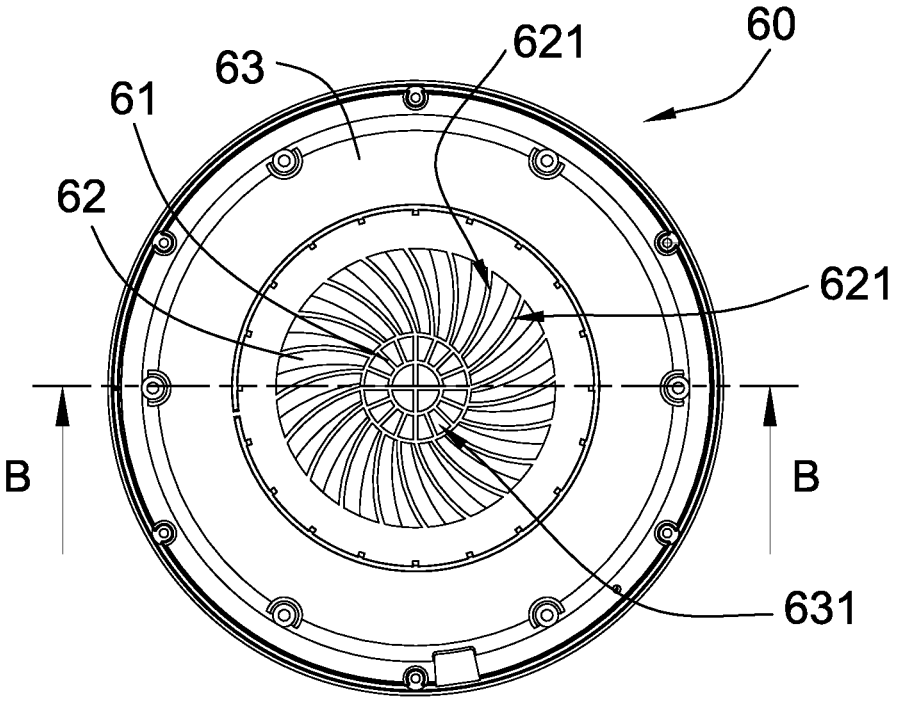
FIG. 9 is a schematic diagram of an air inlet guider of the air purifier according to the preferred embodiment of the present invention.
Figure 10:
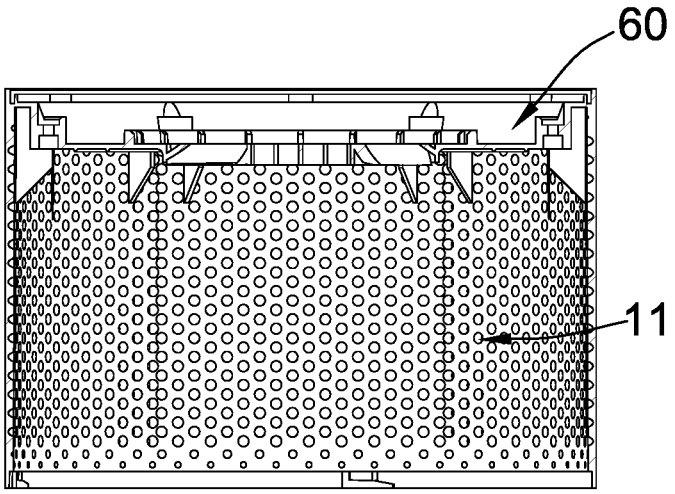
FIG. 10 is sectional view of the air inlet guider along plane B-B of FIG. 9.

As shown in FIG. 9 and FIG. 10 of the drawings, each of the inlet guider blades 62 has two curved side edges 621 extending from the central guiding frame 61 so that when filtered air is arranged to pass through the air inlet guider 60, the inlet guiding blades 62 may pre-direct the air flow and reduce the amount of vortex entering the centrifugal fan 40. Moreover, the inlet guiding blades 62 may be radially and evenly extended from the central guiding frame 61 so that each two adjacent inlet guiding blades 62 may have equal interval with respect to the central guiding frame 61.

It is worth mentioning that the central guiding frame 61, the inlet guider blades 62 and the air blocker frame 63 may form an integral body when the air inlet guider 60 is manufactured. However, each of the central guiding frame 61, the inlet guider blades 62 and the air blocker frame 63 may also form separate components and connect in the manner described above by conventional mechanisms.

A radius of curvature of one side edge 621 of the inlet guider blades 62 may be different from that of the opposed side edge 621 of the corresponding inlet guider blade 62. These radiuses of curvatures may be determined by manufacturing and design circumstances of the present invention. The difference in the radiuses of curvature may eventually define the contour of the corresponding inlet guider blade 62 and the air guiding performance thereof.

As shown in FIG. 3 of the drawings, the air purifier may further comprise a mounting frame 70 mounted in the main housing 10, and a control module 80 mounted on the mounting frame 70. The mounting frame 70 may be provided in the upper housing member 15 at a position above the air outlet guider 50 while the control module 80 may be supported by the mounting frame 70 and may be electrically connected to the driving motor 30. The control module 80 may comprise a control circuitry implemented on a Printed Circuit Board (PCB). The PCB may be supported above the central hub 51 of the air outlet guider 50. The control circuitry may centrally control the operation of the various electrical and mechanical components of the air purifier described above.

The operation of the present invention is as follows: when the air purifier is turned on, the centrifugal fan 40 may be turned on. Air may be drawn from the air inlets 11 and pass through the air filter 21. The air passing through the air filter 21 may be guided to pass through the air inlet guider 60 for being pre-diverted by the inlet guider blades 62 to minimize vortex and noise. After that, air may then pass through the centrifugal fan 40 and the air outlet guider 50. When the air passes through the air outlet guider 50, the air flow may be diverted by the outlet guiding blades 52 in such a manner that vortex flow will be minimized. After passing through the outlet guiding blades 52, filtered will be guided to pass through the outlet blades 18 and discharged out of the main housing 10 through the air discharge member 16.

The present invention, while illustrated and described in terms of a preferred embodiment and several alternatives, is not limited to the particular description contained in this specification. Additional alternative or equivalent components could also be used to practice the present invention.

What is claimed is:

1. An air purifier, comprising:

a main housing having an air inlet and an air outlet;

at least one air filter assembly supported in said main housing;

a driving motor supported in said main housing;

a centrifugal fan connected to said driving motor; and an air outlet guider which is supported in said main housing at a position adjacent to said air outlet and comprises:

a central hub connected to said driving motor;

a plurality of outlet guiding blades outwardly extended from said central hub; and a peripheral rim connected to said central hub at a distance from said central hub to form an air guiding cavity between said central hub and said peripheral rim, said outlet guiding blades extending in said air guiding cavity, wherein when said driving motor is activated to draw air from said air inlet, said air is forced to sequentially pass through said air filter and said air guiding cavity, said air in said guiding cavity being diverted and guided by said outlet guiding blades to form a streamlined flow which is to be discharged through said air outlet, said driving motor comprising a main driving unit and a driving shaft extended from said main driving unit, said central hub of said air outlet guider having an accommodating cavity and an opening for said accommodating cavity, said accommodating cavity being shaped and sized to at least partially accommodate said main driving unit of said driving motor, said opening facing downwardly in said main housing while said driving motor and said centrifugal fan downwardly extending from said air outlet guider.

2. The air purifier, as recited in claim 1, wherein said peripheral rim is concentrically provided at a distance with respect to and from said central hub, said peripheral rim having an annular structure so that said air guiding cavity is formed between an outer side surface of said central hub and an inner side surface of said peripheral rim, said outlet guiding blades extending from said central hub to said peripheral rim.

3. The air purifier, as recited in claim 2, wherein each of said outlet guiding blades has an inner end connected to said outer side surface of said central hub, and an outer end connected to said inner side surface of said peripheral rim, filtered air drawn by said centrifugal fan being forced to pass through said air guiding cavity and diverted by said outlet guiding blades.

4. The air purifier, as recited in claim 3, wherein each of said outlet guiding blades has an upper edge, wherein a direction of extension of said upper edge of each of said outlet guiding blades is offset from a radial direction of said central hub by a predetermined angle of inclination.

5. The air purifier, as recited in claim 4, wherein each of said outlet guiding blades has a decreasing radius of curvature from said outer end to said inner end so that air flowing near said inner end of said corresponding outlet guiding blade is directed and guided to become more streamlined and to move in an upward direction toward said air discharge member.

6. The air purifier, as recited in claim 5, wherein said main housing further comprises a supporting frame mounted in said upper housing member, said supporting frame having a side boundary defining a central cavity surrounded by said side boundary, said centrifugal fan, said driving motor and said air outlet guider being mounted in said upper housing member at a position within said central cavity.

7. The air purifier, as recited in claim 6, wherein said main housing comprise a plurality of air inlets, said air filter being configured to have an annular cross-sectional when viewed from the top and is positioned adjacent to said air inlets so that air flowing from said air inlets is guided to pass through said air filter, filtered air being allowed to pass through said air filter and enter a central space surrounded by said air filter.

8. The air purifier, as recited in claim 7, wherein said main housing comprises a base, a lower housing member connected to and upwardly extended from said base, an upper housing member connected to and upwardly extended from said lower housing member, and an air discharge member supported on top of said upper housing member, said main housing having a receiving cavity extending through said base, said lower housing member and said upper housing member.

9. The air purifier, as recited in claim 5, further comprising an air inlet guider provided in said main housing at a position between said air filter and said centrifugal fan, said air inlet guider comprises an air blocker frame mounted in said main housing to segregate said air filter from said centrifugal fan, a central guider frame mounted in said air blocker frame, and a plurality of inlet guider blades outwardly extended from said central guider frame, filtered air from said air filter being guided to hit said inlet guider blades and pass through spaces formed between said inlet guider blades to reach said centrifugal fan.

10. The air purifier, as recited in claim 9, wherein said air blocker frame has a through central cavity in which said central guider frame and said inlet guider blades are mounted in said central cavity, wherein said filtered air from said air filter is only allowed to pass through said air blocker frame to reach said centrifugal fan through said central cavity.

11. The air purifier, as recited in claim 10, wherein each of said inlet guider blades has two curved side edges extending from said central guiding frame so that when said filtered air is arranged to pass through said air inlet guider, said outlet guiding blades is arranged to pre-direct said air flow and reduce the amount of vortex entering said centrifugal fan.

12. The air purifier, as recited in claim 11, wherein a radius of curvature of one of said side edges of each of said inlet guider blades is different from that of said opposed side edge of said corresponding inlet guider blade.

13. The air purifier, as recited in claim 12, wherein said main housing further comprises a supporting frame mounted in said upper housing member, said supporting frame having a side boundary defining a central cavity surrounded by said side boundary, said centrifugal fan, said driving motor and said air outlet guider being mounted in said upper housing member at a position within said central cavity.

14. The air purifier, as recited in claim 13, wherein said main housing comprise a plurality of air inlets, said air filter being configured to have an annular cross-sectional when viewed from the top and is positioned adjacent to said air inlets so that air flowing from said air inlets is guided to pass through said air filter, filtered air being allowed to pass through said air filter and enter a central space surrounded by said air filter.

15. The air purifier, as recited in claim 14, wherein said main housing comprises a base, a lower housing member connected to and upwardly extended from said base, an upper housing member connected to and upwardly extended from said lower housing member, and an air discharge member supported on top of said upper housing member, said main housing having a receiving cavity extending through said base, said lower housing member and said upper housing member.

* * * * *